United States Patent [19]

Fujimori

[11] Patent Number: 4,768,413

[45] Date of Patent: Sep. 6, 1988

[54] AUTOMATIC PERFORMANCE APPARATUS FOR FACILITATING EDITING OF PRERECORDED DATA

[75] Inventor: Junichi Fujimori, Hamamatsu, Japan

[73] Assignee: Nippon Gakki Seizo Kabushiki Kaisha, Hamamatsu, Japan

[21] Appl. No.: 8,580

[22] Filed: Jan. 29, 1987

[30] Foreign Application Priority Data

Jan. 30, 1986 [JP] Japan ..... 61-18384

[51] Int. Cl.[4] ..... G10H 1/36; G10H 7/00

[52] U.S. Cl. ..... 84/1.03; 84/1.28

[58] Field of Search ..... 84/1.01, 1.03, 1.28, 84/DIG. 12

[56] References Cited

U.S. PATENT DOCUMENTS 3,955,459 5/1976 Mochida et al. .

4,484,507 11/1984 Nakada et al. ..... 84/1.03

4,646,609 3/1987 Teruo et al. ..... 84/1.01

*Primary Examiner*—Stanley J. Witkowski

*Attorney, Agent, or Firm*—Blakely, Sokoloff, Taylor & Zafman

[57] ABSTRACT

An automatic performance apparatus including a memory, a readout means, a musical tone generator, high and low-speed dials and a rotary encoder. The memory stores musical performance in an event style representing the on/off of a key and identifying the key and relative time data representing time between event of said key and the immediately previous event in accordance with musical performance. The readout sequentially reads out the event data from the memory. The musical tone generator is arranged such that the pitch, generation timing and termination timing of the generated musical tone are controlled on the basis of the event data read out by the readout means. A combination of dials and rotary encoders manually designates a readout direction and a readout speed of the stored data. The readout includes a circuit for exchanging the on-data with the off-data (and vice versa) in the memory when the designated readout direction is opposite to the storage order.

4 Claims, 5 Drawing Sheets

AUTOMATIC PERFORMANCE APPARATUS FOR FACILITATING EDITING OF PRERECORDED DATA

BACKGROUND OF THE INVENTION

The present invention relates to an automatic performance apparatus which performs an automatic performance based on musical data recorded in an event style and, more particularly, to an automatic performance apparatus having a search processing function for making editing work or the like easy.

An electronic musical instrument with an automatic performance section for recording in an event style music performed thereby and for reproducing it is exemplified by U.S. Pat. No. 3,855,459 (patented on May 11, 1976).

In an automatic performance apparatus of this type, key event data is recorded in order of occurrence of key depression and key release. Key event data is compiled by recording key depressions and key releases, identifying which key was depressed or released and the relative time sequence of these events. The musical performance is reproduced by reading-out the recorded event data in the order it was recorded. On/off-event data are read-out from the memory in the relative time sequence indicated by recorded time data. Musical tones are reproduced by reading out on/off-event data.

In such automatic performance apparatus recording in event style, it is important that it allow editing of the recorded key event data stored in the memory such as insertion, correction and deletion of said data. In order to edit the performance data or restart performance from a specific part of a musical piece, the desired part must be accurately searched at high speed.

However, while in the conventional apparatus described above, the tempo of a musical piece can be slightly changed upon adjustment of a tempo volume control which controls the frequency of a tempo clock signal for measuring the relative time, this apparatus cannot reproduce the recorded data at a speed suitable for searching. Nor can, the prior art apparatus search in a reverse order, because it is impossible to reproduce a musical performance in reverse of the order the data was encoded into the memory.

SUMMARY OF THE INVENTION

The present invention provides an automatic performance apparatus capable of allowing a user to accurately and quickly search for a desired portion of a musical piece.

Another object of the present invention is to allow the user to easily search for a desired potion of a musical piece.

The present invention, provides an automatic performance apparatus including a memory for storing on/-off-event data representing depression/release of a key, relative time data recording the order of occurrence of the on/off events of a musical performance, key code data identifying the key, and the time between an event and the immediately previous event and means for sequentially reading out the event data from the memory in order of occurrence of evens, means for generating a musical tone signal the pitch of which is determined by the corresponding key-code data, the timing of said tone being controlled by the corresponding on-data and relative time data, and the termination timing of said tone being controlled by the corresponding off-data and relative time data, and readout direction-designating means for manually designating a readout direction of data stored in the memory, said readout means being provided with exchanging means for exchanging the on-data with the off-data and the off-data with the on-data read out from the memory when a designated read-out direction is opposite to the order of occurrence of events.

DESCRIPTION OF THE PREFERRED EMBODIMENT

Figure 1:
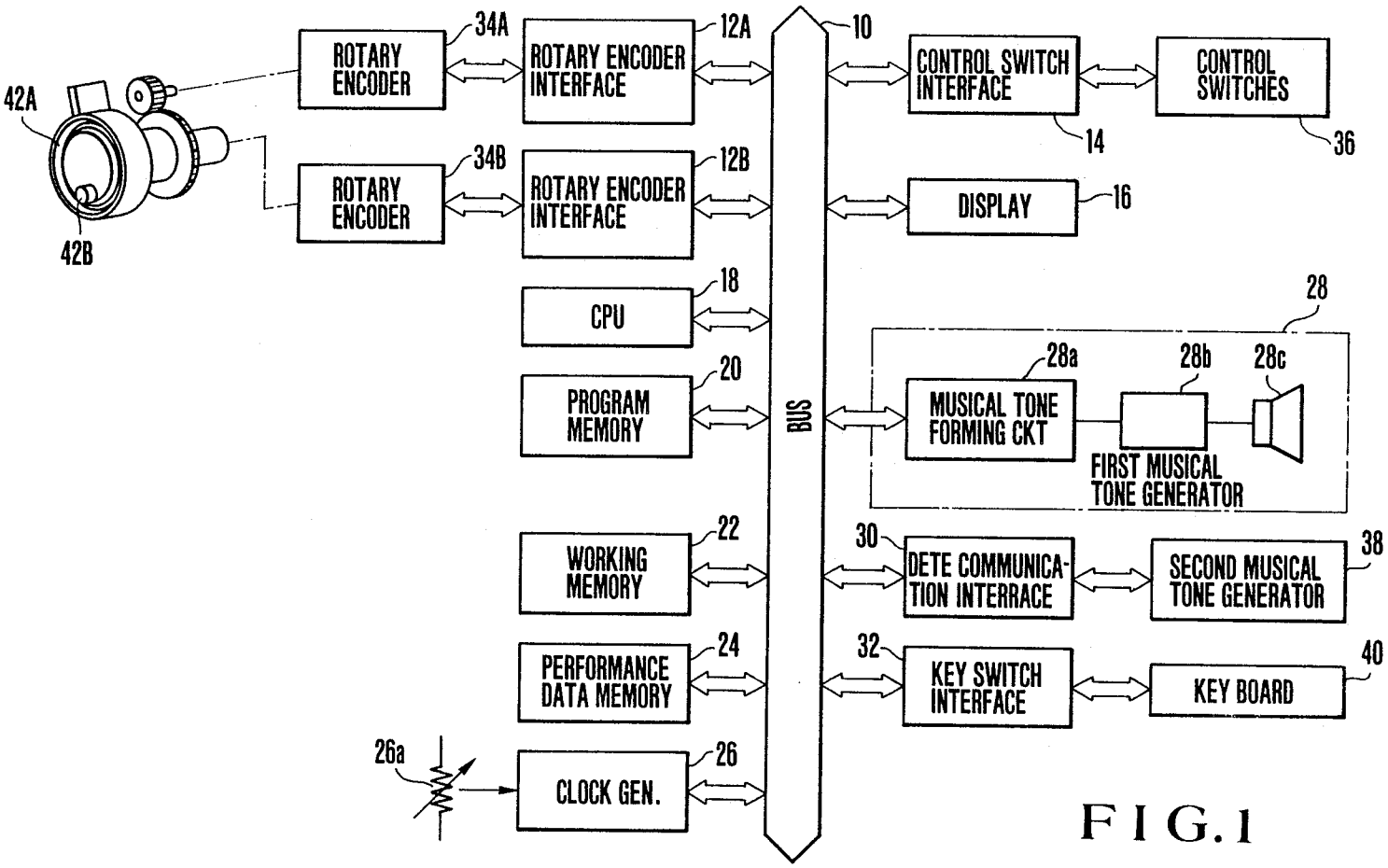
FIG. 1 is a block diagram of an automatic performance apparatus according to an embodiment of the present invention.

FIG. 1 shows a circuit arrangement of an automatic performance apparatus according to an embodiment of the present invention. In the performance apparatus, a microcomputer controls performance recording, performance (automatic musical performance) reproduction, search and editing of musical data.

Circuit Arrangement (FIG. 1)

To a bus 10 are connected rotary encoder interfaces 12A and 12B, a control switch interface 14, a display unit 16, a central processing unit (CPU) 18, a program memory 20, a working memory 22, a performance data memory 24, a clock generator 26, a first musical tone generator 28, a data communication interface 30, and a key switch interface 32.

The rotary encoder interfaces 12A and 12B receive dial operation information delivered from rotary encoders 34A and 34B, respectively, arranged in a search dial unit (to be described in detail later).

Figure 2:
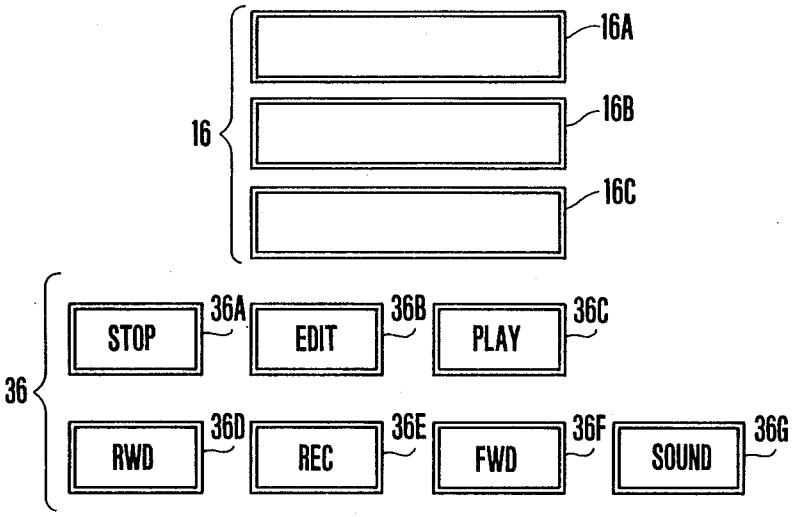
FIG. 2 is a plan view showing disposition of control switches and display elements on a control panel.

The control switch interface 14 receives switch operation information delivered from control switches 36 in FIG. 2. Referring to FIG. 2, reference numeral 36A denotes a stop switch; 36B, an editing switch; 36C, a play switch; 36D, a rewind switch; 36E, a recording switch; 36F, a forward switch; and 36G, a sound switch.

As shown in FIG. 2, the display unit 16 includes an address display element 16A, a data display element 16B, and a temporary register (TR) value display element 16C. The contents of the display elements will be described later.

The CPU 18 executes various operations such as performance recording, performance playing, search, and editing according to programs stored in the program memory 20 as a ROM (Read-Only Memory). The operations of the CPU 18 will be described later with reference to FIGS. 7 and 8.

The working memory 22 comprises a RAM (Random Access Memory) and includes memory areas used as registers and pointers for various operations performed by CPU 18. The registers and pointers used for searching will be described later.

The performance data memory 24 comprises a known readable and writable memory medium such as a RAM, a magnetic tape, a magnetic disk, or an optical disk and stores performance data obtained on the basis of keyboard operations. An example of performance recording will be described later with reference to FIGS. 5 and 6.

The clock generaor 26 generates a tempo clock signal used for measuring time between events in the performance recording or playing mode. The frequency of the tempo clock signal can be arbitrarily changed by a tempo volume control 26*a*.

The first musical tone generator 28 includes a musical tone forming circuit 28*a*, an output amplifier 28*b* for amplifying a musical signal from the musical tone forming circuit 28*a*, and a loudspeaker 28*c* for converting the amplified musical tone signal into an acoustic sound. The first musical tone generator 28 is used to produce a musical tone in the performance recording, performance playing, and search modes.

The data communication interface 30 is called an MIDI (Musical Instrument Digital Interface). The second musical tone generaor 38 in, e.g., an electronic keyboard musical instrument (is connected to the bus 10 through the data communication interface 30 to allow the second musical tone generator 38 to produce musical tones or to allow the bus 10 to receive performance information from the second musical tone generator 38.

The key switch interface 32 scans a large number of key switches activated by the corresponding keys on the keyboard 40 registering key-operation information.

Figure 3:
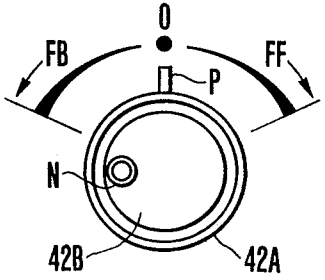
FIG. 3 is a front view of a search dial unit.
Figure 4:
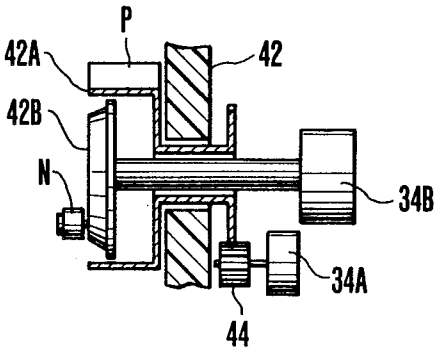
FIG. 4 is a sectional view of the search dial unit.

Search Dial Unit (FIGS. 3 and 4)

FIGS. 3 and 4 show the search dial unit. This unit is positioned on the panel surface near the control switches and display elements in FIG. 2).

A high-speed search dial 42A is mounted on dial holding number 42 in a manner that allows it to rotate. rotary encoder 34A through a gear 44. A pointer projection P is mounted on the dial 42A. If an operator does not move the dial 42A, the projection P is located at the "0" position, as shown in FIG. 3. In this state, the output value of the rotary encoder 34A is zero. When the operator turns the dial 42A in in direction FF forward from the "0" position, an output value of the rotary encoder 42A is a positive value proportional to the angular position of the projection P. However, when the operator turns the dial 42A in a reverse direction FB from the "0" position, the output value of the rotary encoder 34A is a negative value proportional to the angular position of the projection P. Whether the dial 42A is turned in the forward FF direction or in the reverse FB direction, the projection P returns to the "0" position upon release of the dial 42A.

A low-speed search dial 42B is located inside the dial 42A in a manner that allows it to rotate. The dial 42B drives a rotary encoder 34B. A knob N is mounted on the dial 42B. The operator holds the knob N to turn the dial 42B in the forward FF or reverse FB direction encoder 34B is increased when the dial 42B is turned in the forward direction FF. When the dial 42B is turned in the reverse FB direction, the output value is decreased.

Figure 5:
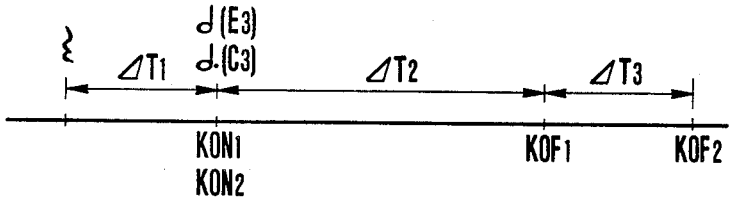
FIG. 5 is a timing chart showing an example of progress of performance.
Figure 6:
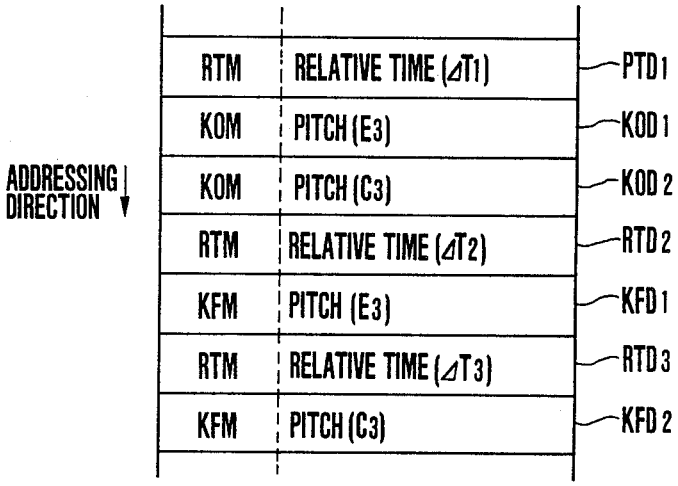
FIG. 6 is a data format of a musical performance recorded in a memory.

Example of Recording (Write Access) of Performance Data Memory 24 (FIGS. 5 and 6)

FIG. 5 shows an example of progress of performance on the keyboard 40 or the like. In this example, the $E_3$ and $C_3$ keys are simultaneously depressed after a rest period corresponding to a quarter rest. The operator releases the $E_3$ key after depressing it for a period corresponding to a half note. He releases the $C_3$ key after depressing it for a period corresponding to a dotted half note. $\Delta T_1$ is time corresponding to a quarter rest. $KON_1$ is a key-on (key depression) timing of the $E_3$ key. $KON_2$ is a key-on timing of the $C_3$ key. $KOF_1$ is a key-off (key release) timing of the $E_3$ key. $KOF_2$ is a key-off (key release) timing of the $C_3$ key. $\Delta T_2$ is time between $KON_1$ ($KON_2$) event and $KOF_2$ event. $\Delta T_3$ is time between $KOF_1$ event and $KOF_2$ event.

In such performance, on/of key data, and relative time data are recorded in the performance data memory 24 in the subroutine in the performance recording mode.

Referring to FIG. 6, $RTD_1$ is relative time data representing $\Delta T_1$; $KOD_1$, on-event data representing depression of $E_3$ key and a pitch corresponding to the $E_3$ key; $KOD_2$, on-event data representing depression of $C_3$ key and a pitch corresponding to the $C_3$ key; $RTD_2$, relative time data representing $\Delta T_2$; $KFD_1$, off-event data representing release of $E_3$ key and a pitch corresponding to the $E_3$ key; $RTD_3$, relative time data representing $\Delta T_3$; and $KFD_2$, off-event data representing release of $C_3$ key and a pitch corresponding to the $C_3$ key. This data data is written in the memory 24 in the order named according to sequence of addressing. The upper two bits of each of relative time data, on-event data, and off-event data, that is, RTM, KOM and KFM represent the type of data. "RTM" is mark bits representing the relative time data; "KOM", mark bits representing the on-event data; and "KFM", mark bits representing the off-event data.

Registers in Working Memory 22

The registers and pointers used for search processing in the working memory 22 are as follows:

(1) Read Control Data Register M

This register stores readout control data generated by settings of the dials 42A and 42B of the search dial unit.

(2) Edit Pointer EP

This pointer serves as an address register for storing address data representing an address of the performance data memory 24. The address display element 16A in FIG. 2 displays a number representing address data set in the address register. The data display element 16B in FIG. 2 displays the content of address data set in this register and the type of data. For example, if on-event or off-event data is detected, a pitch and a sign representing key-on or key-off are displayed. If relative time data is detected, relative time is displayed in the form of a numerical value or in the figure of a note. At the same time, a sign representing the relative time data is also indicated.

(3) Temporary Register TR

This register is used to calculate read control data and the relative time data when performance data is read out from the performance data memory 24. The contents of the temporary register TR are displayed on the TR value display element 16C of FIG. 2.

Figure 7:
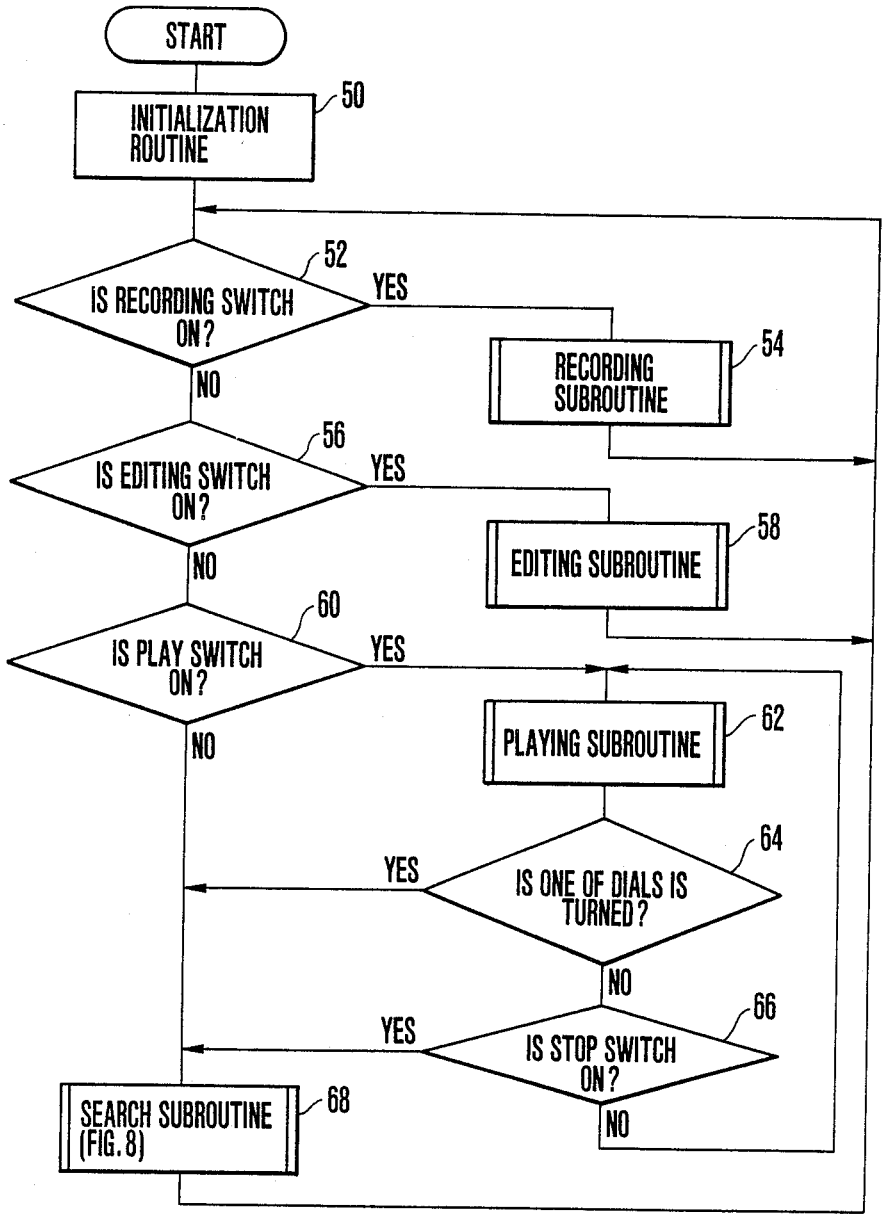
FIG. 7 is a flow chart showing a main routine of the operation of the apparatus.

Main Routine (FIG. 7)

The main routine will be described with reference to FIG. 7.

In step 50, an initialization routine is executed to initialize various registers and pointers. For example, the register M, the pointer EP, and the register TR are set to be 0. The flow then advances to step 52.

The CPU 18 determines in step 52 whether the recording switch 36E is turned on. If YES in step 52, the recording subroutine is executed in step 54. In such recording processing, performance data is recorded in the performance data memory 24. When the stop switch 36A is turned on, the flow returns to step 52.

However, if NO in step 52, the flow advances to step 56. The CPU 18 determines in step 56 whether the editing switch 36B is turned on. If YES in step 56, the editing subroutine is executed in step 58. In the editing subroutine, the recorded performance data is subjected to partial insertion, partial correction, and partial deletion, but a detailed description thereof will be omitted. When the stop switch 36A is turned on, the flow returns to step 52.

However, if NO in step 56, the flow advances to step 60. The CPU 18 determines in step 60 whether the play switch 36C is turned on. If YES in step 60, the playing subroutine is executed in step 62. In this subroutine, performance data is read out from the performance data memory 24. If the performance data is on-event data, the first musical tone generator 28 is controlled to generate a corresponding musical tone. However, if the readout data is off-event data, the generator 28 stops generating the produced corresponding sound. Thereafter, the flow advances to step 64. If readout data is relative time data, pulses of the tempo clock signal from the clock generator 26 are counted. A count represents the event relative time. The flow then advances to step 64.

The CPU 18 determines in step 64 whether one of the dials 42A and 42B in the search dial unit is turned. If NO in step 64, the flow advances to step 66. The CPU 18 determines in step 66 whether the stop switch 36A is turned on. If NO in step 66, the flow returns to step 62. In this step, the same operation as described above is performed. If the previous readout data is relative time data, the pulses of the tempo clock signal are continuously counted. When the operations in steps 62, 64, and 66 are repeated and the count reaches the value represented by the relative time data, the next on- or off-event data is read out. The first musical tone generator 28 is controlled according to the on- or off-event data. By repeating the operation in step 62, music can be performed on the basis of the data stored in the performance data memory 24.

When the stop switch 36A is turned on during or after performance playing, step 66 is determined to be YES, and the flow advances to step 68. When one of the dials 42A and 42B in the search dial unit is is set at a value other than "0", step 64 is determined to be YES, and the flow advances to step 68.

In step 68, the search subroutine is executed, and the flow returns to step 52.

Figure 8:
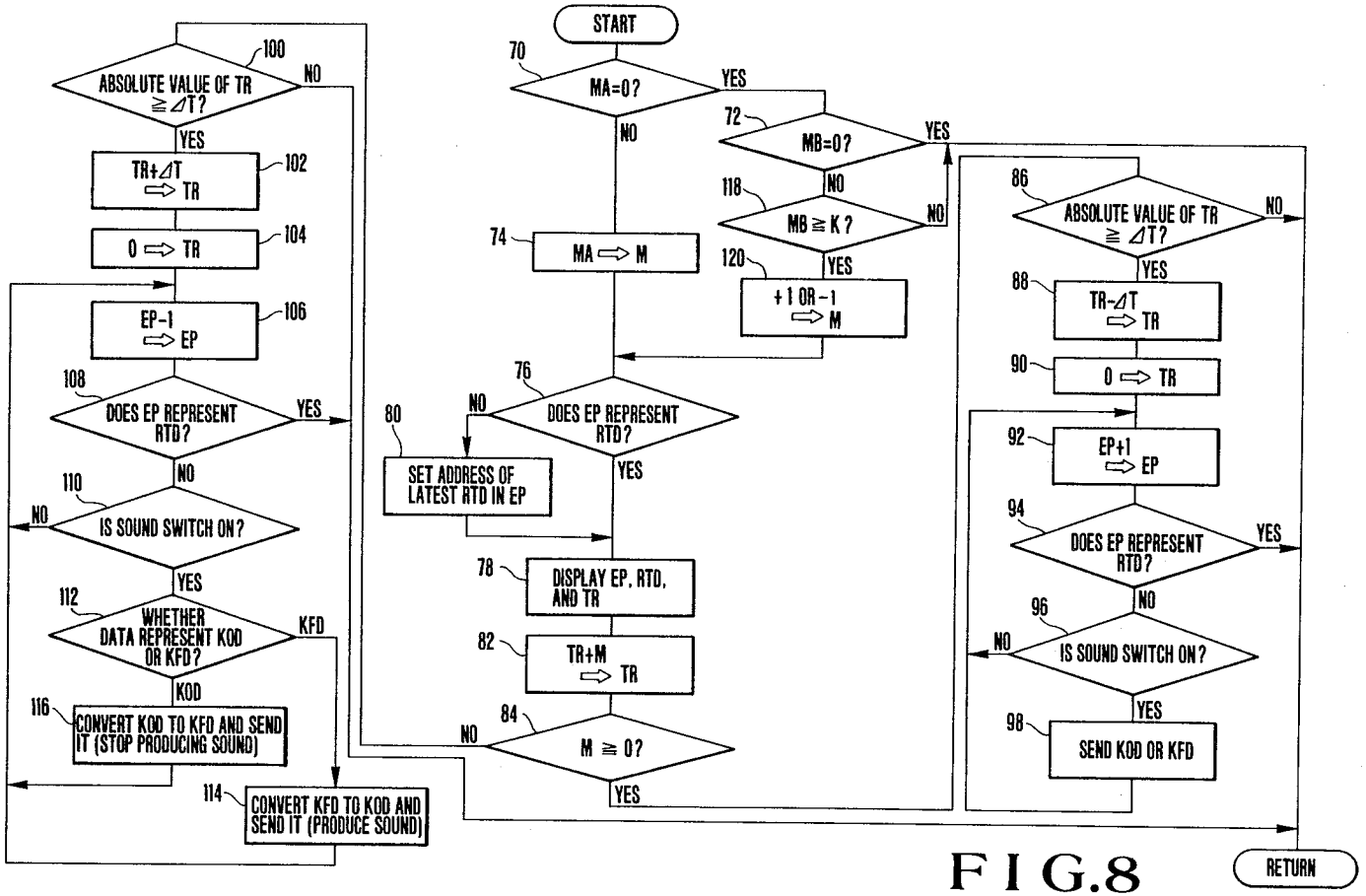
FIG. 8 is a flow chart showing a subroutine of search processing.

Subroutine of Search Processing (FIG. 8)

The subroutine of search processing will be described with reference to FIG. 8.

The CPU 18 determines in step 70 whether an output value MA from the rotary encoder 34A is 0. If YES in step 70, the CPU 18 determines that the dial 42A has not yet been turned, and the flow advances to step 72. The CPU 18 determines in step 72 whether the rate of change (an increment or decrement) MB of an output from the rotary encoder 34B is zero. If YES in step 72, the CPU 18 determines that the dial 42B has not yet been turned. The flow returns to the routine in FIG. 7.

If NO in step 70, the CPU 18 determines the output value is other than "0", the output value MA proportional to the angular position of the dial 42A is read out as control data and is stored in the register M. The flow then advances to step 76.

In step 76, the CPU 18 determines whether the address data set in the editing pointer EP represents the relative time data RTD. If YES in step 76, the flow advances to step 78. However, if NO in step 76, the address data of the latest relative time data RTD is set in the editing pointer EP in step 80, and the flow advances to step 78.

In step 78, the address data (i.e., the EP value) set in the pointer EP is displayed on the address display element 16A, and at the same time, the relative time data RTD of the corresponding address is displayed on the data display element 16B. In this case, the TR value display element 16C displays the current value (a TR value) of the register TR. After initialization is completed, the TR value is zero.

In step 82, the value (an M value) of the register M is added to the TR value, and the sum is set in the register TR. After initialization is completed, the TR value is zero, and the M value is set in the register AR. Thereafter, the flow advances to step 84.

The CPU 18 determines in step 84 whether or not the value of the register M is larger than 0. If the operator turns the dial 42A in the forward direction FF to set the value of the register M to be +10, step 84 is determined to be YES, and the flow advances to step 86.

The CPU 18 determines in step 86 whether the value of the interevent relative time $\Delta T$ is smaller than the absolute value (a value without a sign) of the register TR. In the case of the M value = +10 immediately after the initialization, if the value of T is, e.g., 100, step 86 is determined to be NO, and the flow returns to the routine in FIG. 7. When step 78 is again executed, "+10" is displayed as the TR value. In the next step 82, the TR value is updated to +20. When the above operations are repeated, step 86 is determined to be eventually YES, and the flow advances to step 88.

In step 88, a value obtained by subtracting the $\Delta T$ value from the TR value is set in the register TR. In the above example, since TR value = +100 and $\Delta T$ value = 100, then "0" is set in the register TR.

In step 90, "0" is set in the register TR. If the TR value is set to be "0" in step 88, the TR value is not updated in step 90. However, condition (absolute value of TR) > $\Delta T$ must be taken into consideration in step 86. In this case, the register TR is cleared to zero in step 90. Thereafter, the flow advances to step 92.

The value of the pointer EP is incremented by one in step 92. In other words, the address is incremented by one. The CPU 18 determines in step 94 whether the pointer EP represents the relative time data RTD. If YES in step 94, the flow returns to the routine in FIG. 7. However, if NO in step 94, the pointer EP represents on- or off-event data, and the flow advances to step 96.

The CPU 18 determines in step 96 whether the sound switch 36G is turned on. If YES in step 96, the flow advances to step 98. In step 98, the on- or off-event data KOD or KFD corresponding to the address data set in the pointer EP is sent to the first musical tone generator 28. As a result, the first musical tone generator 28 generates a musical tone corresponding to the on-event data KOD if the reception data represents the on-event data. However, if the reception data represents the off-event data, generation of the corresponding musical tone is interrupted. Thereafter, the flow returns to step 92, and the above operations are repeated.

An example of musical tone generation control will be described with reference to FIG. 6. If the relative time data used in the decision block of step 86 is $RTD_1$, the on-event data $KOD_1$ is sent out in step 98. After the flow returns to step 92, step 94 is determined such that the pointer EP represents the on-event data $KOD_2$. Step 92 is determined to be NO. The flow advances to step 98 through step 96. In step 98, the on-event data $KOD_2$ is set and the $C_3$ sound is produced. In this case, the processing speed is low, a listener listens to the $C_3$ sound as if it is simultaneously produced with the $E_3$ sound. When step 94 is initialized through step 92 again, the pointer EP represents the relative time data $RTD_2$, and step 94 is determined to be YES, and the flow returns to the routine in FIG. 7.

As is apparent from the above description, when the sound switch 36G is turned on in the search mode, musical tones are produced upon their read access. However, when the sound switch 36G is not turned on, step 96 is determined to be NO. In this case, the flow directly returns to step 92 without going through step 98, and musical tone generation control is not performed.

In the above case, condition M value $= +10$ is given. However, when the angle of the dial 42A in the forward direction FF is increased, the M value is increased to increase the readout speed. However, when the angle of the dial 42A is decreased, the readout speed is lowered. In this manner, when any readout speed is set and search operation is started and when a desired music part is checked according to the display contents or tone generation, the operator releases the dial 42A. In this case, the output value MA of the rotary encoder 34A is zero, and performance data read operation is interrupted.

When the dial 42A is turned in the reverse direction FB, a negative value, (e.g., $-10$) is set in the register M in step 74. Since step 84 is determined to be NO, the flow advances to step 100.

In step 100 the CPU 18 determines whether the value of the interevent relative time $\Delta T$ represented by the displayed relative time data RTD is smaller than the absolute value of the register TR. If the $\Delta T$ value is, e.g., 150 and the M value $= -10$, step 100 is determined to be NO, and the flow returns to the routine in FIG. 7. When step 78 is initiated again, "$-10$" is displayed as the TR value. The TR value is updated to $-20$ in step 82. If the above operations are repeated and the TR value is $-150$, step 100 is determined to be YES, and the flow advances to step 102.

In step 102, a value obtained by adding the TR value and the $\Delta T$ value is set in the register TR. In the above case, since TR value $= -150$ and $\Delta T$ value $= 150$, then "0" is set in the register TR. Thereafter, the flow advances to step 104, and "0" is set in the register. This processing is the same as those described with reference to step 90.

In step 106, the value of the pointer EP is decremented by one. In other words, the address is decremented by one. The CPU 18 determines in step 108 whether the pointer EP represents the relative time data RTD. If YES in step 108, the flow returns to the routine in FIG. 7. However, if NO in step 108, the pointer EP represents the on- or off-event data, and the flow advances to step 110.

The CPU 18 determines in step 110 whether the sound switch 36G is turned on. If YES in step 110, the flow advances to step 112. The CPU 18 determines in step 112 whether the data represented by the pointer EP is the on-event data KOD or the off-event data KFD. If the CPU 18 determines that the data is KFD, the flow advances to step 114. However, if the CPU 18 determines that the data is KOD, the flow advances to step 116.

In step 114, the off-event data KFD is converted to on-event data KOD (i.e., the mark bit KFM is converted into KOM), and the converted data is sent to the first musical tone generator 28. As a result, a musical tone corresponding to the converted on-event data KOD is produced. In step 116, the on-event data KOD is converted into off-event data KFD (i.e., the mark bit KOM is converted into KFM), and the converted on-event data KOD is sent to the first musical tone generator 28. A musical tone corresponding to the converted on-event data KOD is produced. After execution of step 114 or 116, the flow returns to step 106.

An example of musical tone generation control will be described with reference to FIG. 6. If the relative time data used in the decision of step 100 is $RTD_3$, the off-event data $KFD_1$ is converted into the on-event data, and the converted data is sent out. Therefore, the $E_3$ tone is produced on the basis of the converted data. After the flow returns to step 106, the CPU 18 determines in step 108 that the pointer EP represents the relative time data $RTD_2$, i.e., the step 108 is determined to be YES. The flow returns to the routine in FIG. 7. Thereafter, processing in step 82 is performed several times. When step 100 is eventually determined to be YES, step 108 is determined to be NO since the pointer EP represents the on-event data $KOD_2$. The flow advances to step 116 through steps 110 and 112. In step 116, the on-event data $KOD_2$ is converted into off-event data, and the $C_3$ sound is synchronously stopped.

When step 108 is initiated through step 106, step 108 is determined to be NO since the pointer EP represents on-event data $KOD_1$. The flow then advances to step 116 through steps 110 and 112. In step 116, the on-event data $KOD_1$ is converted into off-event data. The converted off-event data is sent out, and the corresponding $E_3$ tone is stopped. Thereafter, when the flow advances to step 108 through step 106, step 108 is determined to be affirmative, i.e., YES, and the flow returns to the routine in FIG. 7.

The above processing demonstrates the case wherein the sound switch 36G is turned on. However, if the sound switch 36G is not turnd on, step 110 is determined to be NO, and the flow returns to step 106. Therefore, sound generation control is not performed.

In performance data read processing in the reverse direction, the read speed is changed according to an angle of the dial 42A and the read data is stopped upon release of the dial 42A in the same manner as in performance data read operation in the forward direction.

The effect of rotation of the dial 42B is described as follows. Since the rate of change MB of the output from the rotary encoder 34B is not zero, step 72 is determined to be NO, and the flow advances to step 118.

The CPU 18 determines in step 118 whether the rate of change MB exceeds predetermined value K. If NO in step 118, the flow returns to the routine in FIG. 7. In this case, the rotational angle of the dial 42B is small.

However, if the rotational angle of the dial 42B is larger than the predetermined value K, step 118 is determined to be YES, and the flow advances to step 120. In this step, if the rate of change MB is an increment (i.e., corresponding to rotation along the forward direction FF), +1 is set in the register M. However, if the rate of change MB is a decrement (i.e, corresponding to rotation along the reverse direction FB), −1 is set in the register M. Thereafter, the flow advances to step 76.

The operations in step 76 and the subsequent steps are the same as those for the dial 42A. If the dial 42B is turned in the forward direction FF, the performance data is read out in the forward direction according to the operations in step 86 and the subsequent steps. However, if the dial 42B is turned in the reverse direction, performance data is read out in the reverse direction in the operations in step 100 and the subsequent steps. In this case, the read speed of the performance data is not proportional to the rotational angle as with the dial 42A but to the rotational frequency of the dial 42B. When the dial 42B is quickly turned, the number of additions in step 82 is increased, and step 86 or 100 is determined to be YES.

In the above description, musical tone generation of the first musical tone generator 28 is controlled. However, musical tone generation of the second musical tone generator 38 may be controlled.

In the above embodiment, performance data read operations in the forward and reverse directions are controlled by using the search dial unit. However, as shown in FIG. 2, the performance data read operations in the forward and reverse directions may be controlled by using the forward switch 36F and the reverse switch 36D.

According to the present invention as described above, the read direction and the read speed are arbitrarily set to read out the performance data. Musical tone generation is controlled on the basis of the readout on- and off-event data. Accurate and quick search can be achieved because the operator is able to listen to the produced sounds in the rewinding mode when searching for the desired musical segment.

When search processing according to the present invention is utilized, music can be performd from any desired part thereof, and performance data can be partially changed and edited with ease, thereby realizing a multifunctional automatic performance apparatus.

What is claimed is:

1. An automatic performance apparatus including:

memory means for storing event data which is constructed by on/off-event data and relative time data in order of occurrence of events based on musical performance, said on/of-event data comprising on/off-data representing depression/release of a key relating to an event and key code data identifying said key and relative time data representing time between said event and the immediately previous event;

readout means for sequentially reading out said event data from said memory means in said order of occurrence of events;

musical tone signal generating means for generating a musical tone signal whose pitch is determined by the corresponding key code data, whose generation timing is controlled by the corresponding on-data and relative time data and whose termination timing is controlled by the corresponding off-data and relative time data; and readout direction designating means for manually designating a readout direction of storage contents of said memory means;

said readout means being provided with exchanging means for exchanging the on-data with the off-data and the off-data with on-data of said event data read out from said memory means when a designated readout direction is opposite to said order of occurrence of events.

2. An apparatus according to claim 1, wherein said readout direction designating means comprises a rotary knob, a sensor for detecting a rotational direction of said rotary knob, and direction determining means for determining said readout direction by said rotational direction.

3. An automatic performance apparatus including:

memory means for storing event data which is constructed by on/off-event data and relative time data in order of occurence of events based on musical performance, said on/off-event data comprising on/off-data representing depression/release of a key relating to an event and key code data identifying said key and relative time data representing time between said event and the immediately previous event;

readout rate designating means for designating a readout rate of said event data from said memory means;

timing determining means for determining a readout timing for reading out the data from said memory means, on the basis of a value associated with the designated readout rate;

readout means for reading out said eventdata from said memory means on the basis of said readout timing, said readout means including means for converting off-event data to on-event data and on-event data to off-event data in said memory means when said off-event data and on-event data are read out from the reverse of the direction in which said on-event data and off-event data are stored;

musical tone signal generating means for generating a musical tone signal whose pitch is determined by the corresponding key code data, whose generation timing is controlled by the corresponding on-data and relative time data and whose termination timing is controlled by the corresponding off-data and relative time data.

4. An apparatus according to claim 3, wherein said readout rate designating means comprises a rotary knob and sensor means for sending out a signal associated with a rotation amount of said rotary knob.

* * * * *

UNITED STATES PATENT AND TRADEMARK OFFICE

CERTIFICATE OF CORRECTION

PATENT NO. : 4,768,413

DATED : 09/06/88

INVENTOR(S) : Fujimori

It is certified that error appears in the above-identified patent and that said Letters Patent is hereby corrected as shown below:

| COLUMN | LINE | DESCRIPTION |
|---|---|---|
| 08 | 57 | delete "turnd" insert --turned-- |
| 09 | 58 | delete "/of event" insert --/off event-- |
| 10 | 43 | delete "eventdata" insert --event data-- |

Signed and Sealed this

Fourteenth Day of February, 1989

*Attest:*

*Attesting Officer*

DONALD J. QUIGG

*Commissioner of Patents and Trademarks*